United States Patent [19]

Namba

[11] 4,348,579

[45] Sep. 7, 1982

[54] FIXING ROLL IN A COPYING MACHINE

[75] Inventor: Yoshiharu Namba, Ebina, Japan

[73] Assignee: Rank Xerox Limited, London, England

[21] Appl. No.: 160,766

[22] Filed: Jun. 16, 1980

[30] Foreign Application Priority Data

Jun. 28, 1979 [JP] Japan ..... 54-087569

[51] Int. Cl.[3] ..... H05B 3/02; B21B 27/06

[52] U.S. Cl. ..... 219/216; 219/469; 355/3 FU; 432/60

[58] Field of Search ..... 355/3 R, 3 FU, 14 FU; 219/216, 469, 470, 471; 432/60, 228

[56] References Cited

U.S. PATENT DOCUMENTS

| | | | |
|---|---|---|---|
| 3,612,820 | 10/1971 | Punnett | 219/216 |
| 4,127,764 | 11/1978 | Minden | 432/60 X |
| 4,284,875 | 8/1981 | Namiki et al. | 219/216 |

*Primary Examiner*—Fred L. Braun

[57] ABSTRACT

Heat and pressure fuser apparatus for fixing toner images to substrates passing through a nip formed between two pressure engaged roll structures, at least one of the roll structures being heated and contacting the toner images as the substrates pass through the nip. The apparatus being characterized by a heated fuser roll structure having a thin circumferential wall wherein reinforcing structure is provided internally thereof for rendering the thin circumferential wall sufficiently rigid to withstand the pressures to which it is subjected during fusing.

3 Claims, 5 Drawing Figures

FIXING ROLL IN A COPYING MACHINE

BACKGROUND OF THE INVENTION

This invention relates generally to xerographic copying apparatus and more particularly, it relates to the heat and pressure fixing of particulate thermoplastic toner by direct contact with a heated fusing member.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto.

In order to affix or fuse electroscopic toner material onto a support member by heat, it is necessary to elevate the temperature of the toner material to a point at which the constituents of the toner material become tacky and coalesce. This action causes the toner to flow to some extent into the fibers or pores of the support members or otherwise on the surfaces thereof. Thereafter, as the toner material cools, solidification of the toner material occurs causing the toner material to be bonded firmly to the support member. In both the xerographic as well as the electrographic recording arts, the use of thermal energy for fixing toner images onto a support member is old and well known.

One approach to thermal fusing of electroscopic toner images onto a support has been to pass the support with the toner images thereon between a pair of opposed roller members, at least one of which is internally heated.

Heat fixing devices of electronic copying machines are generally of a construction, as shown in FIG. 1, such that a paper b with transferred toner images is urged by a pressure roll c against a fixing roll a which contains a heat source d. By the application of pressure and heat of the fixing roll a the toner image is fused and fixed on the paper b. To this end, the fixing roll a is required to have a high strength, for example, it will have a wall thickness large enough to withstand a high pressure. However, where the circumferential wall thickness is relatively large so as to be able to withstand the pressures to which it is subjected, it has a correspondingly large heat capacity resulting in a prolonged time being required between the time when heating is started until when the fusing temperature is reached, thus making immediate copying impossible.

BRIEF SUMMARY OF THE INVENTION

According to the present invention, which has been accomplished with a view to remedying such drawbacks, as noted hereinabove, there is provided a fixing roll in a copying machine, said fixing roll being able to withstand high pressures, having a small wall thickness and a small heat capacity and being of simple construction.

DETAILED DESCRIPTION OF THE PREFERRED EMBODIMENT OF THE INVENTION

This invention is more fully described below with reference to an embodiment thereof shown in FIGS. 2–5.

Figure 1:
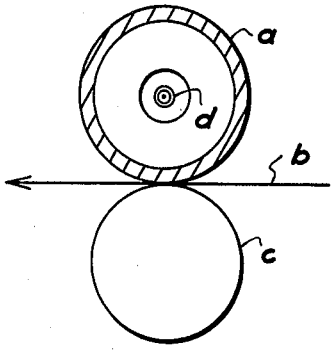
FIG. 1 illustrates a general heat fixing device.
Figure 2:
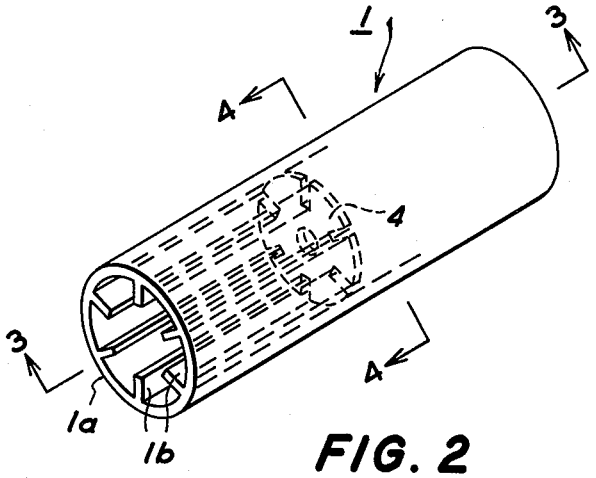
FIG. 2 is a perspective view of the fixing roll according to an embodiment of the present invention.
Figure 4:
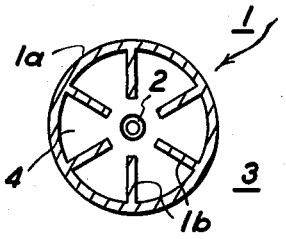
FIG. 4 is a sectional view taken on the line 4—4 in FIG. 2.
Figure 3:
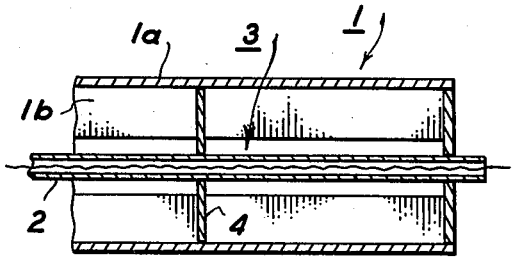
FIG. 3 is a sectional view taken on line 3—3 in FIG. 2.
Figure 5:
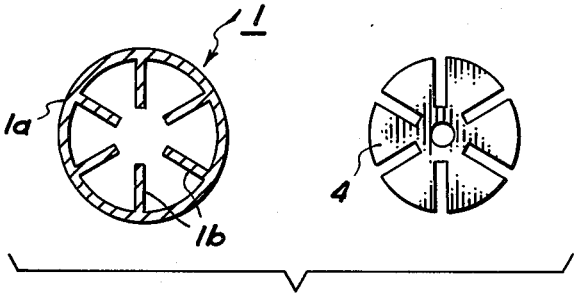
FIG. 5 illustrates a modification of a support member forming a part of the roll structure shown in FIG. 2.

In the accompanying drawings, the reference number 1 is a cylindrical, fixing roll body 300 mm in length and 30 mm in diameter having a circumferential wall 1*a* which is thin (i.e. 1.0 mm) enough to make its heat capacity small. From the inner surface of the circumferential wall 1*a* there project a plurality of reinforcing ribs 1*b* having a thickness of 0.8 mm which project toward the center so that the free ends of the reinforcing ribs 1*b* define a cavity 3 to receive therein a heat source 2. Furthermore, on the inner surface of the circumferential wall 1*a* of the fixing body 1 there are mounted, integrally with the body 1 and in plural places, reinforcing plates 4 having a thickness of 1.5 mm which fortify each reinforcing rib 1*b* in their circumferential direction. Alternatively, as shown in FIG. 5, the reinforcing plates 4 may be formed separately from the body 1, then inserted in the body 1 from an end face side thereof and fixed to the circumferential wall 1*a* and the reinforcing ribs 1*a*. The roll end plate members are preferably fabricated from aluminum.

According to this device, as set forth hereinabove, the fixing roll body 1 is fortified or reinforced by a plurality of reinforcing ribs 1*b* projecting from the inner surface of the circumferential wall 1*a* of the body 1, so that even when the circumferential wall 1*a* of the body is made thin a sufficient strength is obtained, whereby it becomes possible to provide, easily and inexpensively, a fixing roll which is superior in pressure resistance and is small in capacity.

I claim:

1. Heat and pressure fuser apparatus for fixing toner images to copy substrates passing through a nip formed between two pressure engaged roll structures, at least one of the roll structures being heated and contacting the toner images as the substrates pass through said nip, the improvement comprising:

said at least one of said roll structures being characterized by a cylindrical configuration having an outer circumferential wall which is relatively thin thereby having a relatively small heat capacity for minimizing the time required to elevate it to the fusing temperature, said at least one of said roll structures further characterized by reinforcing means associated with said circumferential wall for rendering said relatively thin wall sufficiently rigid to withstand the pressures to which it is subjected during fusing, said reinforcing means comprising a plurality of reinforcing ribs extending along the length of said wall and radially inward toward the center of said at least one roll structure, said at least one of said roll structures being further characterized by the provision of a plurality of plate members disposed transversely relative to the longitudinal axis of said at least one of said roll structures and provided with slots for receiving said reinforcing ribs, said plate members cooperating with said reinforcing ribs to render said circumferential wall rigid.

2. Apparatus according to claim 1 wherein said plate members are comprised of aligned openings through which a heat lamp may be inserted.

3. Apparatus according to claim 1 wherein said plate members are formed integrally with said circumferential wall.

* * * * *